US009365307B2

(12) United States Patent
Smits

(10) Patent No.: US 9,365,307 B2
(45) Date of Patent: Jun. 14, 2016

(54) DEVICE AND A METHOD FOR PACKAGING SUBSTANTIALLY FLAT PRODUCTS IN A BOX

(75) Inventor: Antonius Adrianus Arnoldus Smits, Landsmeer (NL)

(73) Assignee: Guk-Sigma B. V., Den Ilp (NL)

( * ) Notice: Subject to any disclaimer, the term of this patent is extended or adjusted under 35 U.S.C. 154(b) by 605 days.

(21) Appl. No.: 13/822,798

(22) PCT Filed: Sep. 15, 2010

(86) PCT No.: PCT/EP2010/063553

§ 371 (c)(1),
(2), (4) Date: Mar. 13, 2013

(87) PCT Pub. No.: WO2012/034591

PCT Pub. Date: Mar. 22, 2012

(65) Prior Publication Data

US 2013/0167478 A1 Jul. 4, 2013

(51) Int. Cl.
*B65B 5/06* (2006.01)
*B65B 9/00* (2006.01)
(Continued)

(52) U.S. Cl.
CPC ... *B65B 9/00* (2013.01); *B65B 5/06* (2013.01); *B65B 5/106* (2013.01); *B65B 25/141* (2013.01); *B65B 35/44* (2013.01); *B65B 43/59* (2013.01)

(58) Field of Classification Search
CPC ..... B65G 17/26; B65G 17/22; B65B 5/06; B65B 5/068; B65B 9/00
USPC ..... 53/531, 447
See application file for complete search history.

(56) References Cited

U.S. PATENT DOCUMENTS 3,822,528 A * 7/1974 Carlsson ..... B65B 5/061 53/542
4,098,392 A * 7/1978 Greene ..... B65G 47/32 198/419.3

(Continued)

FOREIGN PATENT DOCUMENTS

DE 2821898 A1 11/1979
DE 2821989 11/1979

(Continued)

OTHER PUBLICATIONS

PCT Application No. PCT/EP2010/063553, International Search Report and Written Opinion of the International Searching Authority mailed Mar. 22, 2012.

(Continued)

*Primary Examiner* — Gloria R Weeks
(74) *Attorney, Agent, or Firm* — The Webb Law Firm

(57) ABSTRACT

A device for packaging products in a box, includes a frame having a moving conveyor, a guide for supporting the products from an entry end to an exit end of the guide, and a mechanism for holding a box at the exit end of the guide such that the opening of the box extends parallel to the guide at the other side thereof. The conveyor has support members extending perpendicular to the conveyor and towards the guide when they move along the guide. The device further includes a feeder for feeding the products at the entry end of the guide between two support members, wherein the products are stacked in parallel for moving the stack of products at the exit end past the edge of the exit end into-said the box, and a mechanism for transporting the box in a direction parallel to the guide.

17 Claims, 6 Drawing Sheets

(51) Int. Cl.

| | |
|---|---|
| ***B65B 5/10*** | (2006.01) |
| ***B65B 25/14*** | (2006.01) |
| ***B65B 35/44*** | (2006.01) |
| ***B65B 43/59*** | (2006.01) |

(56) References Cited

U.S. PATENT DOCUMENTS

| | | | | | |
|---|---|---|---|---|---|
| 4,226,073 | A * | 10/1980 | Rose | B65B 5/101 | 53/247 |
| 4,641,742 | A * | 2/1987 | Igarashi | B65G 15/105 | 198/626.5 |
| 4,736,570 | A * | 4/1988 | Hardage | B65B 23/12 | 53/443 |
| 4,744,201 | A * | 5/1988 | Total | B65B 35/44 | 198/419.3 |
| 4,893,707 | A * | 1/1990 | Langen | B65G 17/26 | 198/626.3 |
| 4,998,399 | A * | 3/1991 | Lutzke | B65G 47/084 | 198/419.3 |
| 5,038,919 | A * | 8/1991 | Harston | B65G 17/26 | 198/626.1 |
| 5,095,684 | A * | 3/1992 | Walker | B65B 57/12 | 198/462.2 |
| 5,897,291 | A * | 4/1999 | Gerwe | B65B 35/24 | 198/374 |
| 6,161,678 | A * | 12/2000 | Cassoli | B65G 17/26 | 198/626.6 |
| 6,182,814 | B1 * | 2/2001 | Koehler | B65B 23/14 | 198/418.7 |
| 6,971,839 | B2 * | 12/2005 | Cerutti | B65B 23/14 | 198/418.6 |
| 7,220,094 | B2 * | 5/2007 | Cerutti | B65B 23/14 | 198/430 |
| 8,002,105 | B2 * | 8/2011 | Duchemin | B65G 47/29 | 198/419.2 |
| 2001/0050209 | A1 | 12/2001 | Takemoto et al. | | |
| 2004/0098948 | A1 | 5/2004 | Caporali et al. | | |
| 2009/0313955 | A1 | 12/2009 | Gudim et al. | | |

FOREIGN PATENT DOCUMENTS

| | | |
|---|---|---|
| EP | 1231148 | 8/2002 |
| GB | 2306450 A | 5/1997 |
| GB | 2306450 | 7/1997 |

OTHER PUBLICATIONS

PCT Application No. PCT/EP2010/063553, International Preliminary Report on Patentability and Written Opinion of the International Searching Authority mailed Mar. 28, 2013.

* cited by examiner

DEVICE AND A METHOD FOR PACKAGING SUBSTANTIALLY FLAT PRODUCTS IN A BOX

CROSS-REFERENCE TO RELATED APPLICATIONS

This national stage patent application under 35 U.S.C. §371 claims priority to PCT application no. PCT/EP2010/063553 filed Sep. 15, 2010, the disclosure of which is incorporated herein by reference for all purposes.

BACKGROUND

The disclosure relates to a device for packaging substantially flat products in a box.

SUMMARY

In particular, the disclosure relates to packaging paper booklets or folded papers in a carton box, said box having the width and height of one product, and a length so as to contain a multitude of said products, for instance at least 20, 50 or more products.

Traditionally such paper booklets or folded papers are put in the carton boxes manually. A need therefore exists for a low cost, high speed, reliable and/or efficient method.

According to the disclosure, the device comprises a frame having a moving endless stack conveyor, a guide for supporting the products at one side of the guide during transport from an entry end to an exit end of said guide, which guide extends parallel to said conveyor, means for holding a box at the exit end of said guide such that the opening of the box extends parallel to said guide at the other side thereof, said stack conveyor having support members spaced apart at regular intervals along said conveyor, extending perpendicular to the conveyor and towards said guide when they move along said guide, a feeder for feeding said products at the entry end of said guide between two spaced apart support members in an orientation wherein said products are stacked parallel to said support members, means for moving said stack of products at the exit end in a direction perpendicular to said guide and past the edge of said exit end into said box, and means for transporting the box in a direction parallel to said guide in order to make room for a next stack of products.

Preferably said endless conveyor comprises two parallel spaced apart chains, and said support members are elongated beams, one end of each of said beams being attached to said chains.

Preferably said feeder comprises at least one pair of endless feeder conveyors, parts of which run parallel against each other from a feeder entry end to a feeder exit end, said feeder exit end being located near the edge of the entry end of said guide. Said pairs of endless feeder conveyors preferably each comprise at least two endless cords.

Preferably said guide comprises a pair of parallel spaced apart rails.

Preferably said means for moving a stack of products into the box is a reciprocating push member.

Preferably a temporary guide is located at the exit end of said guide, extending in line with said guide, said temporary guide being provided with means for moving the temporary guide out of line with said guide to allow the stack of products past the edge of the guide into said box. Said temporary guide is preferably formed such that said stack of products pushes said temporary guide out of line with the guide when said stack of products is moved into the box. Said temporary guide preferably comprises two spaced apart parallel rails, which are hinged along an axis parallel to and substantially in line with the outer sides of the guide.

Preferably said means for transporting the box comprises a reciprocating hook, which is arranged to move over a stack of products in a box, and pull the stack with the box in said direction. Said transport direction of the box is preferably counter the direction of movement of the products on the guide.

Preferably the device comprises an end guide for guiding a stack of products into a box, which end guide extends perpendicular to the guide, at a distance from the edge of the exit end of said guide and during use extends into the box, said distance being equal to the distance between the support members.

Preferably the device comprises means for exchanging a filled box with an empty box.

Preferably the device comprises digital input means for inputting the number of products that fit between two support members. Preferably the device comprises counting means, preferably an optical sensor, for counting the number of products being fed at the entry end of the guide, and means for accelerating said stack conveyor when the correct number of products is fed between two support means, and for slowing down said stack conveyor when said support means have past. Preferably the device comprises means for calculating and regulating the speed of the stack conveyor in dependency of the number of products that fit between two support members.

The disclosure also relates to a method for packaging substantially flat products in a box, wherein products are transported in stacks from an entry end to an exit end of a guide, said guide supporting the products at one side thereof, said products being transported by a stack conveyor having support members spaced apart at regular intervals along said conveyor and extending perpendicular to the conveyor and towards said guide while they move along said guide, wherein a feeder feeds said products at the entry end of said guide between two spaced apart support members in an orientation wherein said products are stacked parallel to said support members, wherein a box is held at the exit end of said guide such that the opening of the box extends parallel to said guide at the other side thereof, and said stack of products are moved at the exit end in a direction perpendicular to said guide and past the edge of said exit end into said box, and wherein the box is transported in a direction parallel to said guide in order to make room for a next stack of products.

BRIEF DESCRIPTION OF THE DRAWINGS

Embodiments of the present disclosure are illustrated in the following drawings which depict an example embodiment according to the disclosure. These drawings are not intended to limit the scope of the disclosure.

DETAILED DESCRIPTION

Figure 1:
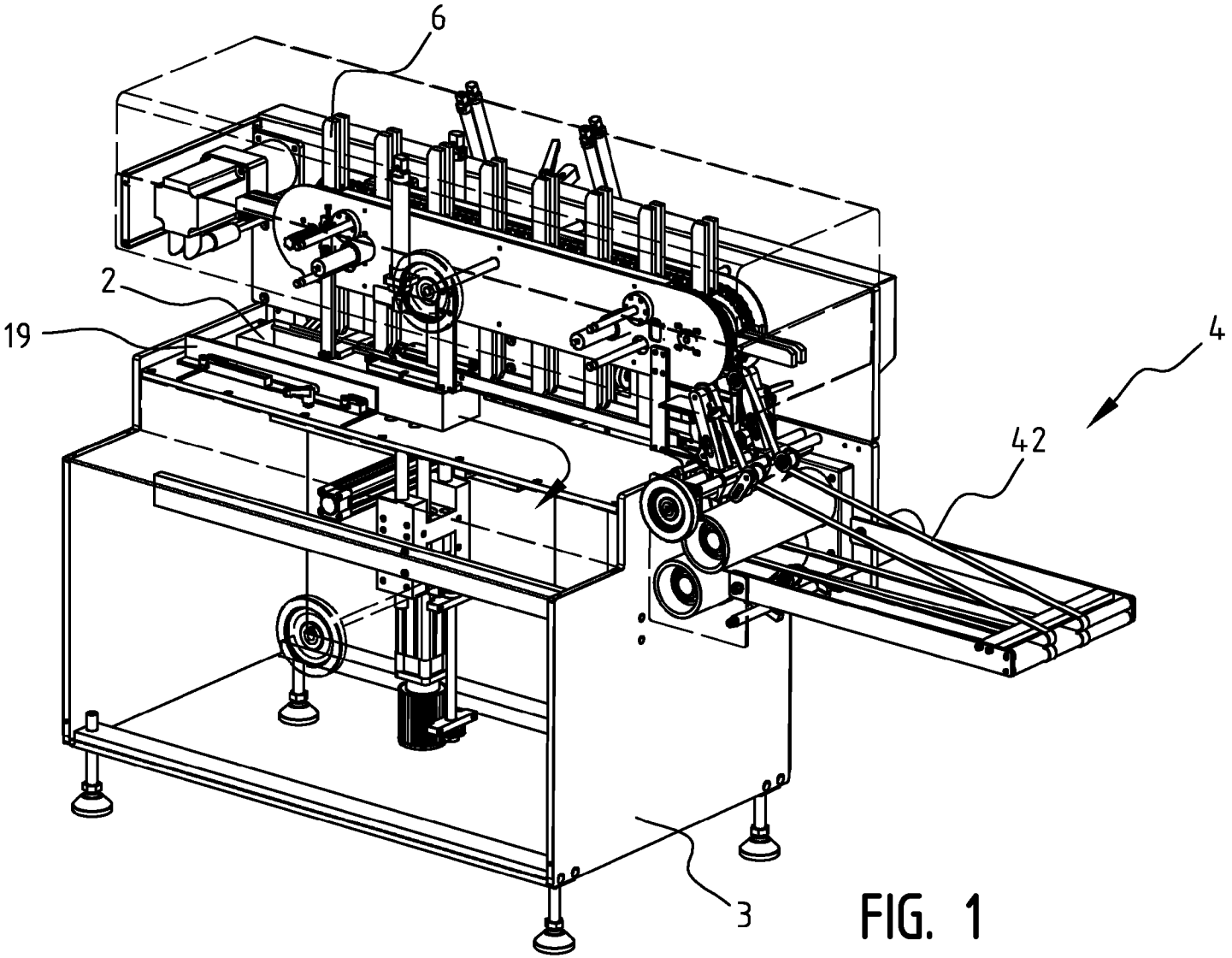
FIGS. 1 and 2 show a partially open perspective, respective front and rear, views of a device in accordance with one embodiment of disclosure.
Figure 2:
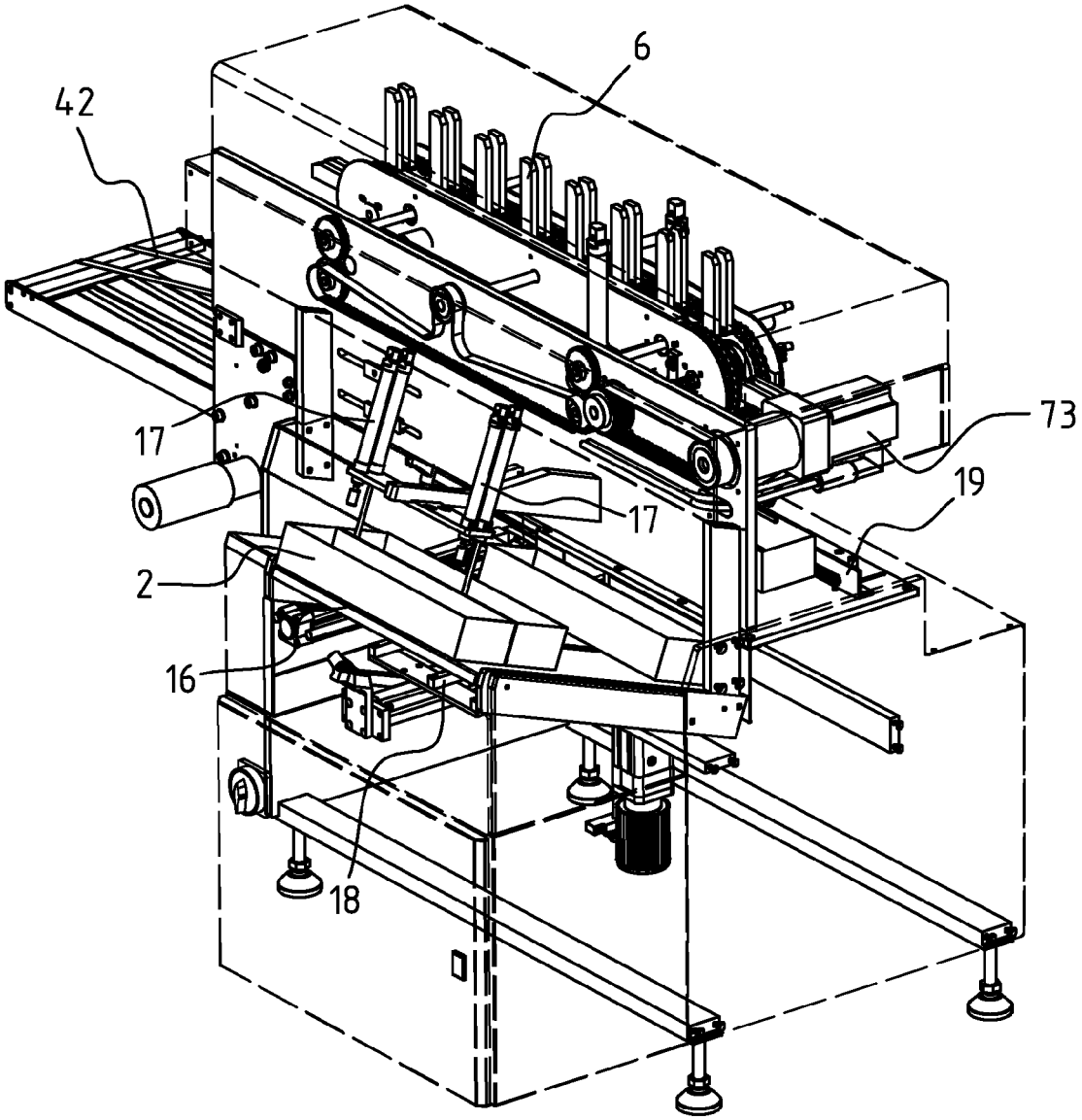
Figure 3:
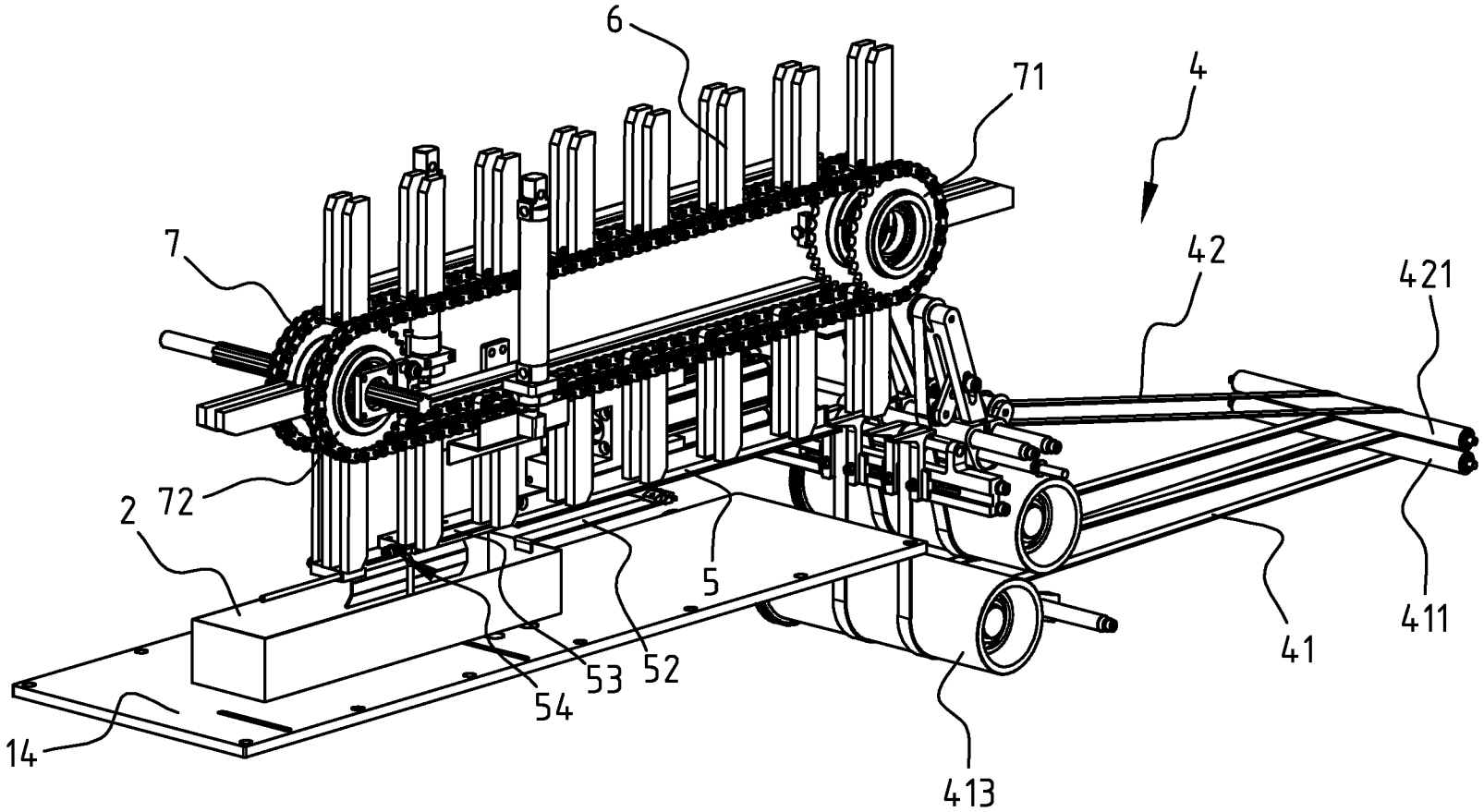
FIG. 3 shows a perspective front view of a part of the device of FIGS. 1 and 2.

According to FIGS. 1, 2 and 3 a device for packaging booklets 1 in carton boxes 2 comprises a frame 3 arranged to stand on a floor. The frame 3 is connected to a feeder 4, through which the booklets 1 are fed in a substantially continuous flow to the device.

Figure 4:
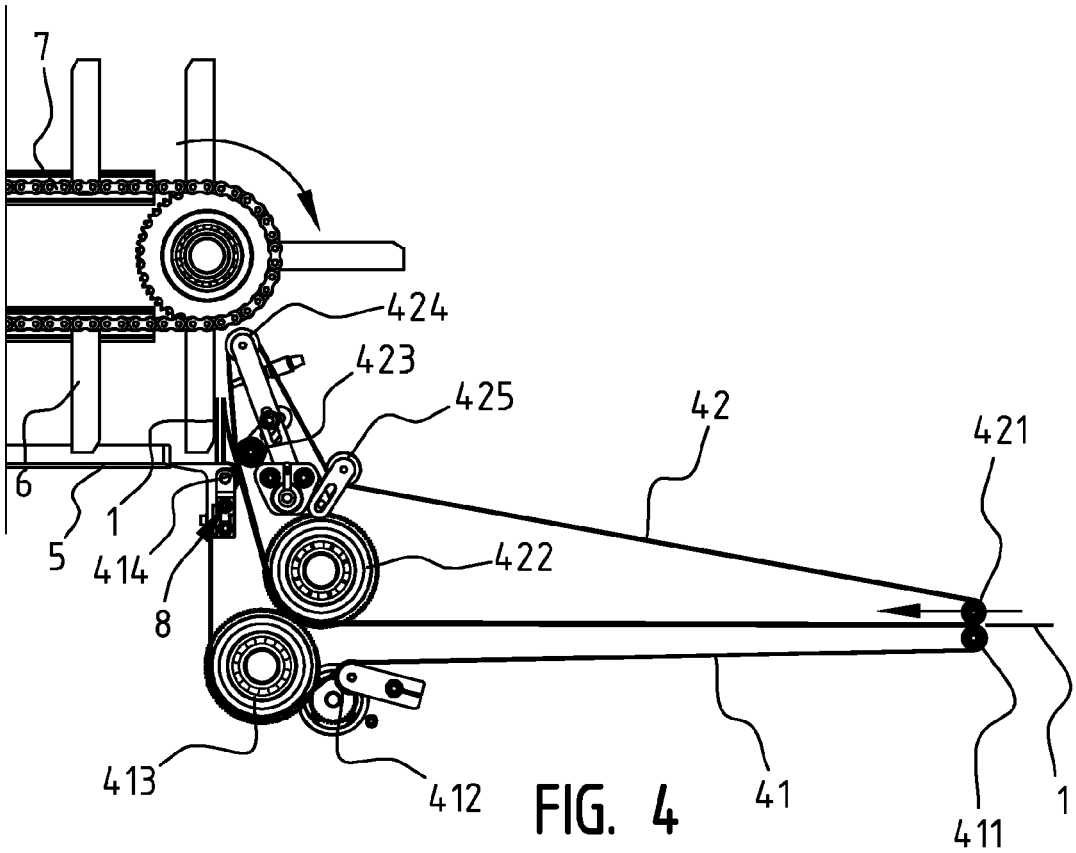
FIGS. 4 and 5 show front views of a part of the device of FIGS. 1 and 2 in two different stages of use.
Figure 5:
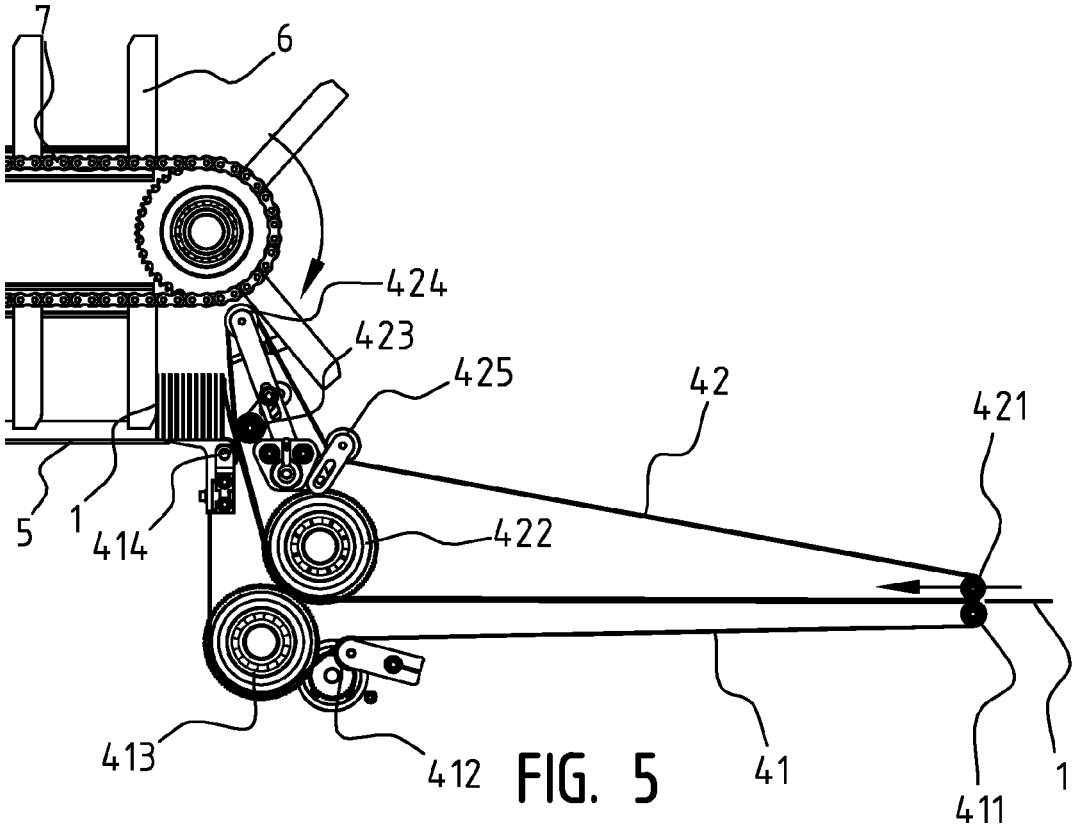

As shown in FIGS. 4 and 5, the feeder 4 comprises two pairs of driven endless cords 41, 42. Said cords 41, 42 of each pair run against each other along a generally sloping track from a lower feeder entry end to an upper feeder exit end, so that booklets which are fed to the feeder entry will be transported therebetween to the feeder exit.

Guide rails 5 are arranged adjacent the exit end of the feeder, for guiding stacks of booklets 1 from an entry end of the guide rails 5, which is the exit end of the feeder 4, to an exit end of the guide rails 5, where the stacks of booklets 1 are moved down into the boxes 2. The stacks of booklets 1 are built up from the continuously fed booklets 1 between slowly moving pairs of vertical support members 6, as will be described below. Said support members 6 are beam shaped, and are at one outer end attached to a pair of driven endless moving chains 7. Each chain 7 extends on two gears 71, 72, of which gear 72 is driven by a motor 73.

The upper endless cords 42 are arranged on guide wheels 421, 423, 424, 425. Guide wheel 423 is located at the exit end of the feeder 4 which forms the entry end of the guide rails 5, but the cords 42 extend beyond the entry end of the guide rails 5, substantially perpendicular thereto in upward direction, so that they will keep supporting the back side of the booklets 1 when these enter the space between two pairs of support members 6. Each pair of support members 6 move between the space of these upright parts of upper endless cords 42.

The lower endless cords 41 are arranged on guide wheels 411, 412, 413, 414 and 422, such that between guide wheels 411, 421 on the feeder entry side and guide wheels 414, 423 on the feeder exit side the cords 41, 42 run against each other, whereby they can hold and move the booklets 1 from the entry to the exit of the feeder 4. Guide wheels 413, 422 are driven by a motor.

The device further comprises electronic input means for entering the number of booklets 1 that fit in a stack between two pairs of support members 6, as well as an optical sensor 8, which is located near the exit end of the feeder 4, for counting the number of booklets 1 that pass into the space between the pairs of supporting members 6. When the maximum number of booklets 1 in said space is reached, the chain 7 is temporarily accelerated, for allowing the pair of support members 6 to pass the feeder exit before the next booklet 1 exits the feeder 4. In order to allow this first booklet to be guided into the space between the support members 6, the support members 6 have bevelled edges at their backsides.

The frame is further provided with a box carrying platform 14, which is located under the booklet guide rails 5. The box carrying platform 14 is movable in vertical direction by a pneumatic cylinder, in order to place the boxes 2 in the correct position under the booklet guide platform 5 for being filled with booklets 1. A sloping feeder 16 with lateral guides is located adjacent the carrying platform 14, on which a carton box 2 to be filled can be placed manually. Movable holding elements 17 hold the box on the sloping feeder 16 until a signal is received that the box can be released onto the carrying platform 14. The holding elements then move upwards so that the box 2 slides down onto the carrying platform 14 and then the box 2 is pushed by pusher elements 18 in the correct position against a guide rail 19. The carrying platform 14 is then moved upwards by the cylinder so that the bent outer end of vertical end guide 51 reaches down into the box 2, as well as the end of hook 52 against the inner front side thereof.

Figure 6:
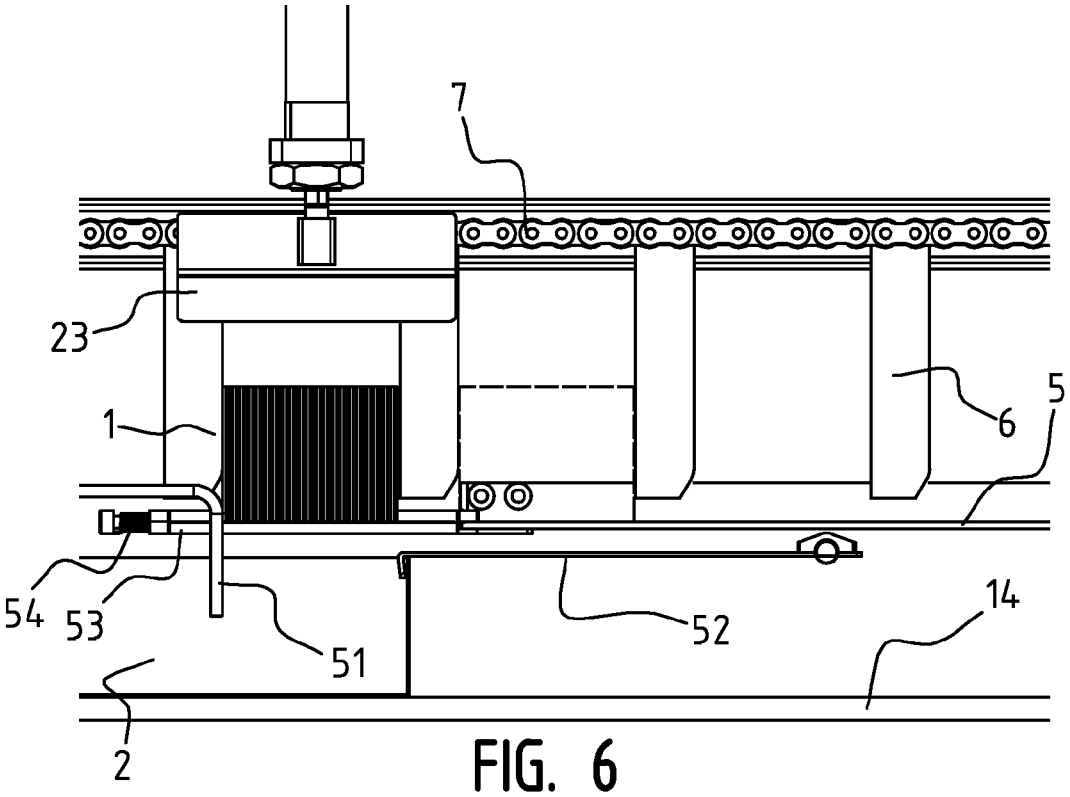
FIGS. 6, 7, 8 and 9 show front views of a part of the device of FIGS. 1 and 2 in four different stages of use.
Figure 7:
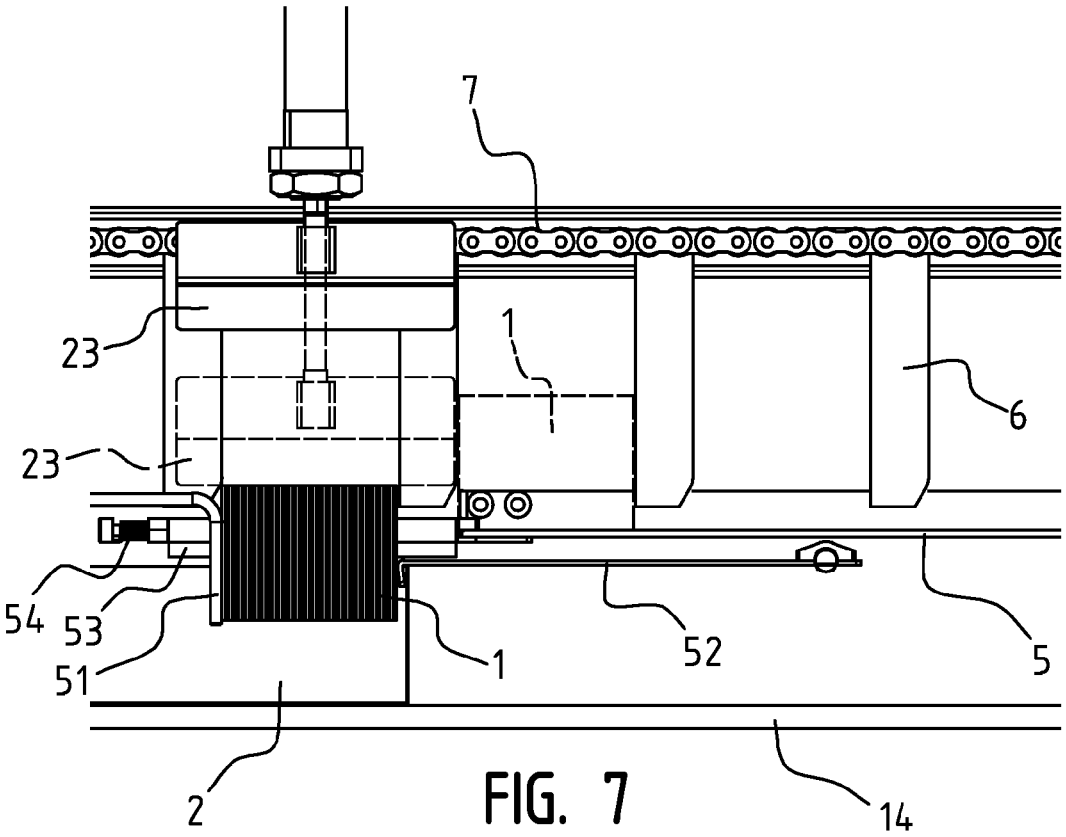

Two hinged temporary guide rails 53 extend from the exit end of guide rails 5, extending in line with said guide 5. Said temporary guide rails are downwardly hingeable. The temporary rails 53 are held in the upward position by spring means 54, such that the stack of booklets 1 is supported by the rails 53. When the stack of booklets has arrived at the position shown in FIG. 6, where it bumps against the vertical guide 51, a push member 23 is moved up and down between the support members 6, so that it pushes the stack of booklets 1 down, whereby the temporary guide rails 53 are pushed and rotate against the spring force of springs 54 out of line with the guide rails 5, such that a sufficiently wide gap is provided to allow the stack of booklets 1 to move past the edge of the guide 5 into the box 2, as shown in FIGS. 6 and 7.

Figure 8:
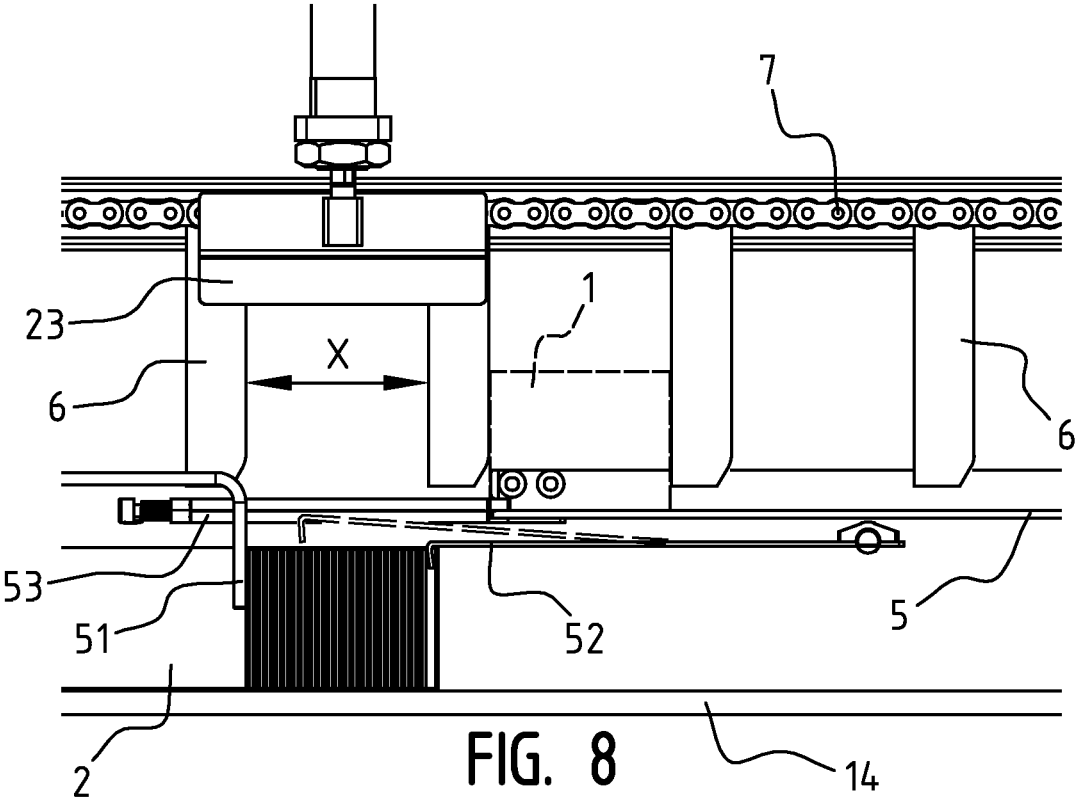
Figure 9:
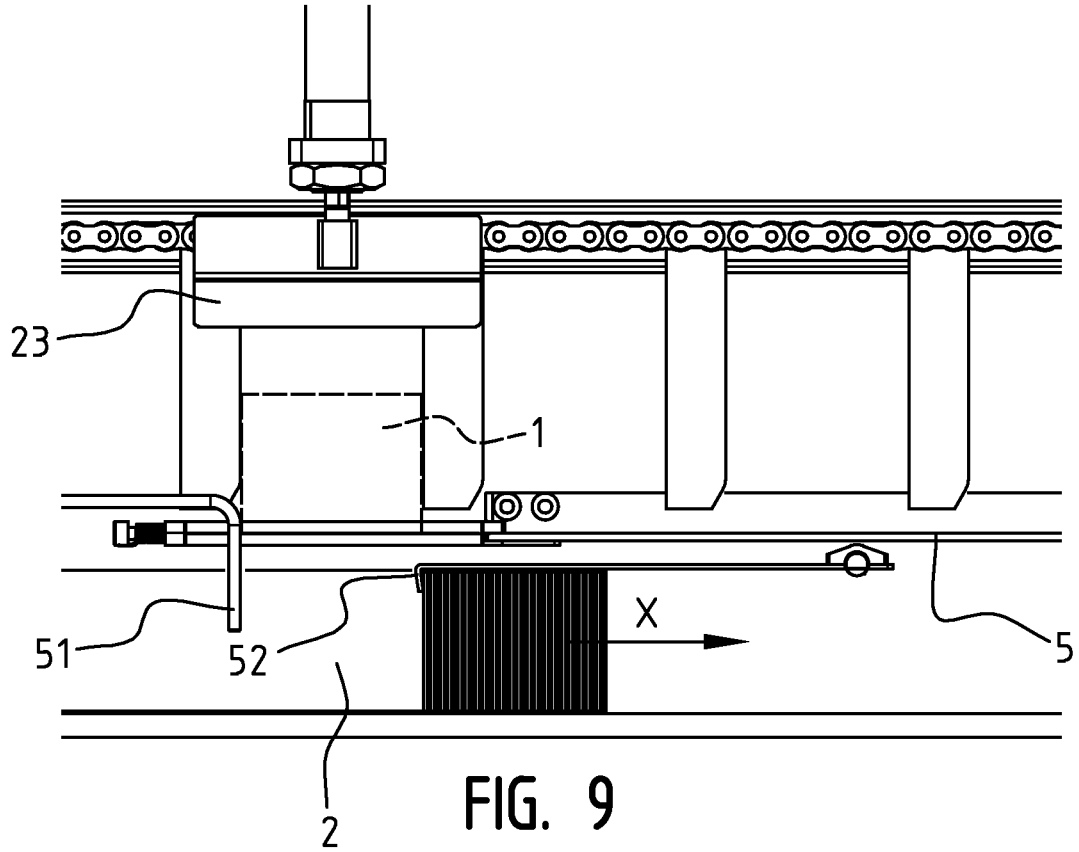

As the box 2 is being filled with stacks of booklets 1, the box is being repeatedly moved forward over a distance X, which is equal to the distance X between the pairs of support members 6, by the reciprocating hook 52 as shown in FIGS. 8 and 9. The hook 52 is slightly rotated upward to move the end of the hook 52 upward as it is moved over the last stack of booklets that was pushed into the box 2, as shown in FIG. 8, and then the hook 52 is moved downward so that it engages this stack and pulls it together with the box 2 in the direction of arrow X. When the box 2 is full and in its end position, the box carrying platform 14 is lowered by the cylinder, and a bumper pushes the box towards the front of the device, where it is taken out manually. A new, empty box 2 is simultaneously released from the feeder 16, and placed in the correct position.

The invention claimed is:

1. A device for packaging substantially flat products in a box, comprising:

a frame having a moving endless stack conveyor;

a guide for supporting products at a first side of the guide during transport from an entry end to an exit end of said guide, wherein the guide extends parallel to said conveyor;

means for holding a box at the exit end of said guide such that an opening of the box extends parallel to said guide at a second side of the guide, said stack conveyor having support members spaced apart at regular intervals along said conveyor, extending perpendicular to the conveyor and towards said guide when the support members move along said guide;

a feeder for feeding said products at the entry end of said guide between two spaced apart support members in an orientation wherein said products are stacked parallel to said support members;

means for moving said stack of products at the exit end in a direction perpendicular to said guide and past an edge of said exit end into said box; and means for transporting the box in a direction parallel to said guide in order to make room for a next stack of products, wherein said means for transporting the box comprises a reciprocating hook, which is arranged to move over a stack of products in a box, and pull the stack with the box in said direction.

2. The device in accordance with claim 1, wherein said endless conveyor comprises two parallel spaced apart chains, and said support members are elongated beams, one end of each of said beams being attached to said chains.

3. The device in accordance with claim 1, wherein said feeder comprises at least one pair of endless feeder conveyors, parts of which run parallel against each other from a feeder entry end to a feeder exit end, said feeder exit end being located near an edge of the entry end of said guide.

4. The device in accordance with claim 3, wherein said pair of endless feeder conveyors each comprise at least two endless cords.

5. The device in accordance with claim 1, wherein said guide comprises a pair of parallel spaced apart rails.

6. The device in accordance with claim 1, wherein said means for moving a stack of products into the box includes a reciprocating push member.

7. The device in accordance with claim 1, wherein a temporary guide is located at the exit end of said guide, extending in line with said guide, said temporary guide being provided with means for moving the temporary guide out of line with said guide to allow the stack of products past the edge of the guide into said box.

8. The device in accordance with claim 7, wherein said temporary guide is formed such that said stack of products pushes said temporary guide out of line with the guide when said stack of products is moved into the box.

9. The device in accordance with claim 8, wherein said temporary guide comprises two spaced apart parallel rails, which are hinged along an axis parallel to and substantially in line with the outer sides of the guide.

10. The device in accordance with claim 1, wherein said transport direction of the box is counter the direction of movement of the products on the guide.

11. The device in accordance with claim 1, wherein the device comprises an end guide for guiding a stack of products into a box, which end guide extends perpendicular to the guide, at a distance from the edge of the exit end of said guide and during use extends into the box, said distance being equal to the distance between the support members.

12. The device in accordance with claim 1, wherein the device comprises means for exchanging a filled box with an empty box.

13. The device in accordance with claim 1, wherein the device comprises counting means for counting the number of products being fed at the entry end of the guide, and means for accelerating said stack conveyor when the correct number of products is fed between two support means, and means for slowing down said stack conveyor when said support means have past the entry end of the guide.

14. A device for packaging substantially flat products in a box, comprising:

a frame having a moving endless stack conveyor wherein the endless conveyor includes two parallel spaced apart chains;

a guide for supporting products at a first side of the guide during transport from an entry end to an exit end of said guide, wherein the guide extends parallel to said conveyor and includes a pair of parallel spaced apart rails;

means for holding a box at the exit end of said guide such that an opening of the box extends parallel to said guide at a second side of the guide, said stack conveyor having support members spaced apart at regular intervals along said conveyor, extending perpendicular to the conveyor and towards said guide when the support members move along said guide, wherein the support members are elongated beams, one end of each of the beams being attached to the chains;

a feeder for feeding said products at the entry end of said guide between two spaced apart support members in an orientation wherein said products are stacked parallel to said support members, wherein said feeder includes at least one pair of endless feeder conveyors, parts of which run parallel against each other from a feeder entry end to a feeder exit end, said feeder exit end being located near an edge of the entry end of said guide and wherein the at least one pair of endless feeder conveyors each include at least two endless cords;

means for moving said stack of products at the exit end in a direction perpendicular to said guide and past an edge of said exit end into said box wherein the means for moving includes a reciprocating push member; and means for transporting the box in a direction parallel to said guide in order to make room for a next stack of products, wherein said means for transporting the box comprises a reciprocating hook, which is arranged to move over a stack of products in a box, and pull the stack with the box in said direction.

15. The device in accordance with claim 14, wherein a temporary guide is located at the exit end of said guide, extending in line with said guide, said temporary guide being provided with means for moving the temporary guide out of line with said guide to allow the stack of products past the edge of the guide into said box.

16. The device in accordance with claim 15, wherein said temporary guide is formed such that said stack of products pushes said temporary guide out of line with the guide when said stack of products is moved into the box.

17. The device in accordance with claim 16, wherein said temporary guide comprises two spaced apart parallel rails, which are hinged along an axis parallel to and substantially in line with the outer sides of the guide.

* * * * *